US006371063B2

(12) United States Patent
Oyama et al.

(10) Patent No.: US 6,371,063 B2
(45) Date of Patent: Apr. 16, 2002

(54) VALVE-OPEN-CLOSE MECHANISM

(75) Inventors: Hitoshi Oyama; Takao Nishioka; Kenji Matsunuma; Takatoshi Takikawa; Toshihiko Kaji; Nozomu Kawabe; Kouichi Sogabe, all of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/731,818

(22) Filed: Dec. 8, 2000

(30) Foreign Application Priority Data

| | | |
|---|---|---|
| Dec. 9, 1999 | (JP) | 11-349868 |
| May 19, 2000 | (JP) | 2000-148499 |
| Oct. 20, 2000 | (JP) | 2000-321007 |

(51) Int. Cl.[7] ..... F01L 9/04
(52) U.S. Cl. ..... 123/90.11; 123/90.67
(58) Field of Search ..... 123/90.11, 90.67, 123/188.13

(56) References Cited

U.S. PATENT DOCUMENTS

| | | | |
|---|---|---|---|
| 4,993,376 A | 2/1991 | Fukutome et al. | 123/90.65 |
| 5,553,369 A | 9/1996 | Shimizu et al. | 29/888.46 |
| 6,298,812 B1 * | 10/2001 | Izuo et al. | 123/90.11 |

FOREIGN PATENT DOCUMENTS

| | | |
|---|---|---|
| DE | 19851214 | 11/1999 |
| DE | 19958175 | 2/2001 |
| EP | 0985806 | 3/2000 |
| JP | 02-102307 | 4/1990 |
| JP | 05-141211 | 6/1993 |
| JP | 06-010627 | 1/1994 |
| JP | 11-93629 | 4/1999 |

* cited by examiner

*Primary Examiner*—Wellun Lo
(74) *Attorney, Agent, or Firm*—McDermott, Will & Emery

(57) ABSTRACT

It is proposed to lessen the weight and improve the mechanical strength of a retainer of a valve open-close mechanism driven by an electromagnetic actuator used in an automotive internal combustion engine. The electromagnetic actuator is mounted in a housing mounted on an internal combustion engine body. A first stem has its tip abutting the valve, which is provided with a retainer and carries a first coil spring. A second stem is provided on the other side of an armature. The second stem has a retainer. Between this retainer and the housing, a second coil spring is mounted. At least one of these parts is made of a metal smaller in specific weight than iron or its alloy. Each retainer has a boss and an arcuate corner portion having a radius of curvature R of 1.0 mm or over between a spring abutting surface and the boss to relieve stress concentration.

10 Claims, 6 Drawing Sheets

VALVE-OPEN-CLOSE MECHANISM

BACKGROUND OF THE INVENTION

The present invention relates to a valve-open-close mechanism operated by an electromagnetic actuator and used mainly in an automotive internal combustion engine.

A conventional valve-open-close mechanism for automotive internal combustion engines is disclosed e.g. in Japanese patent publication 11-93629. Referring to FIG. 1, which shows one embodiment of the present invention, an electromagnetic actuator 4 includes a pair of electromagnets 6, 7 each made up of a stator 5 and a coil 18 that are opposed to each other by with a gap S therebetween. An armature 3 is disposed in the gap 10 so as to be reciprocable between two electromagnets 6, 7. A first stem 15 for transmitting the movement of the armature 3 from the electromagnet 6 toward the one electromagnet 7 to external is provided on one surface of the armature 3.

The electromagnetic actuator 4 is housed in a housing 8 fixed in an internal combustion engine 19. The tip of the first stem 15 of the electromagnetic actuator 4 is brought into abutment with the tip of the valve 9 so that by moving the armature 3 toward the electromagnet 7, the first stem 15 pushes the valve 9 to open it. Further, in order to impart a biasing force for opening the valve 9, a retainer 13 is provided on the valve 9, and a first return spring 2 is mounted between the retainer 13 and the internal combustion engine body 19; a second stem 14 is provided on a surface opposite to the surface of the armature 3 on which is provided the first stem 15; and the retainer 13 is provided on the second stem 14, and a second return spring 1 for imparting a biasing force in the direction in which the second stem 14 pushes the armature 3 is mounted between the retainer 13 and the housing 8.

In this valve-open-close mechanism, the weights of directly driven parts during actuation have a direct influence on the driving power consumption of the electromagnetic actuator 4 as an inertia weight. Since the driving power is normally supplied from an on-board battery, an increase in the power consumption is not preferable. Also, the weights of other parts that are not directly driven will also has a direct influence on the total weight of the internal combustion engine. Thus, if it is used in an automobile, it will have a direct influence on the fuel consumption.

But heretofore, for these parts, as disclosed in the above publication, no consideration has been given regarding the material and lightening of the weight and iron-family or steel-family materials having a specific weight of 7 to 8 are used.

In attempting to lighten the weight of each of these parts, a reduction in the mechanical strength of each part will result from lightening of the weight. For the retainer 3, mechanical strength to withstand a load from the coil spring 1 or 2 is required.

An object of this invention is to provide a retainer which can sufficiently withstand a spring load even if its weight is reduced.

SUMMARY OF THE INVENTION

In order to solve this object, according to the present invention, the retainer comprises a boss and a surrounding spring support, and in view of the fact that the corner portion extending from the spring support to the boss is the weakest portion subjected to the spring load, the corner portion of the retainer is formed to be arcuate. Since it is arcuate, stress concentration is relieved, so that chipping at the corner portion is eliminated.

According to this invention, there is provided the valve-open-close mechanism for an internal combustion wherein the electromagnetic actuator comprises a pair of electromagnets each made up of a stator and a coil opposed to each other with a gap therebetween; an armature disposed in the gap so as to be reciprocable between the pair of electromagnets by driving the electromagnets; and a first stem for transmitting to external the movement of the armature from one electromagnet toward the other electromagnet; the electromagnetic actuator being housed in a housing mounted to an internal combustion engine body; the armature being moved from the one electromagnet toward the other electromagnet, so that the first stem opens the valve by pushing the valve; the electromagnetic actuator further comprising a first retainer provided on the valve for imparting a biasing force to the valve for a valve-closing operation, and a first return spring mounted between the first retainer and the internal combustion engine body; a second stem provided at a surface of the armature on the side not coupled to the first stem; and a second retainer provided on the second stem, and a second return spring mounted between the second retainer and the housing for imparting a biasing force.

According to this invention, the radius of curvature R of the arc of the corner portion is derived from the following formula:

$$K=P\times d\times(1-0.4R)\leqq C\times t=Q[N\cdot\mathrm{mm}]$$

wherein

Q: Allowable stress for the retainer 13

P: Spring load produced when spring 1, 2 is compressed to the limit d: Wire diameter (mm) of spring 1, 2 t: Fatigue strength of material used for retainer

C: Constant

Here, the permissible stress level Q of the retainer is, as will be apparent from the above formula, a value determined by the material, and is obtained from the experiment results as a numerical value which is correlated with the stress state (See the below-described mechanical strength test for the retainer.). P×d is a stress level applied to the retainer and (1−0.4R) is an approximate formula for stress concentration defined in a non-dimension. They were obtained by this kind of experiments. R is a numerical value in millimeter as a unit.

Since arcuation of the corner portion achieves lowering of stress concentration, it is necessary not to form steps at the continuous portion between the end of the arcuate corner portion and the spring abutting surface of the retainer and the end of the boss peripheral surface in view of cut-out effect. In particular, it is preferable that the corner portion has such an arcuate shape that the curvature gradually increases toward the abutting surface and the peripheral surface of the boss.

The retainer is preferably formed of a powder molded article such as an aluminum alloy hardened material by forging. The arcuate shape of the corner portion may be formed simultaneously with the formation of the retainer or formed by machining after molding.

At least one of the first stem, second stem, housing, valve, first return coil spring and second return coil spring may be formed of a metal smaller in specific weight than iron, its alloy, an alloy reinforced with aggregate and having a smaller specific weight than iron, a ceramics, a fiber- or whisker-strengthened ceramics.

If a metal smaller in specific weight than an iron-family member which has a specific weight of 7–8, its alloy, an alloy reinforced with aggregate, a ceramics, or a fiber- or whisker-strengthened ceramic material, which has heretofore been used, is used for the parts, this leads to reduction in the inertia weight and total weight.

According to the present invention, the first return coil spring or second return coil spring is made of an alloy steel containing 0.55–0.70 wt % of C, 1.0–2.2 wt % of Si, 1 wt % or under of Cr, 1 wt % or under of Mn, 0.2 wt % or under of V, having a tensile strength of 1960 $N/mm^2$ or over, containing inclusions of a size of 25 $\mu$m or under, and having a tempered martensitic structure.

Further, besides the desired spring properties, for achieving a reduction in weight, the first return spring or second return spring is made of a titanium alloy comprising a total of 13 wt % or over of Al and V, having a tensile strength of 1500 $N/mm^2$ or over and having a surface coating having a good wear resistance.

Furthermore, in order to achieve a similar object, the first return spring or second return spring is made of an aluminum alloy containing a total of 5 wt % or more of Cu, Mg and Zn, having long crystal particles having an aspect ratio of the crystal particle diameter of 3 or over, and a tensile strength of 600 $N/mm^2$ or over.

Also, while the valve comprises a marginal portion and a stem portion, in order to maintain heat resistance of the marginal portion and reduce the weight, the marginal portion may be made from a heat-resistant steel alloy and the stem portion may be made from an aluminum alloy sintered member formed by powder molding.

Also, in order to achieve a similar object, the valve may be made from a ceramic material whose major component is silicon nitride or SIALON.

Other features and objects of the present invention will become apparent from the following description made with reference to the accompanying drawings, in which:

DETAILED DESCRIPTION OF THE PREFERRED EMBODIMENT

Figure 1:
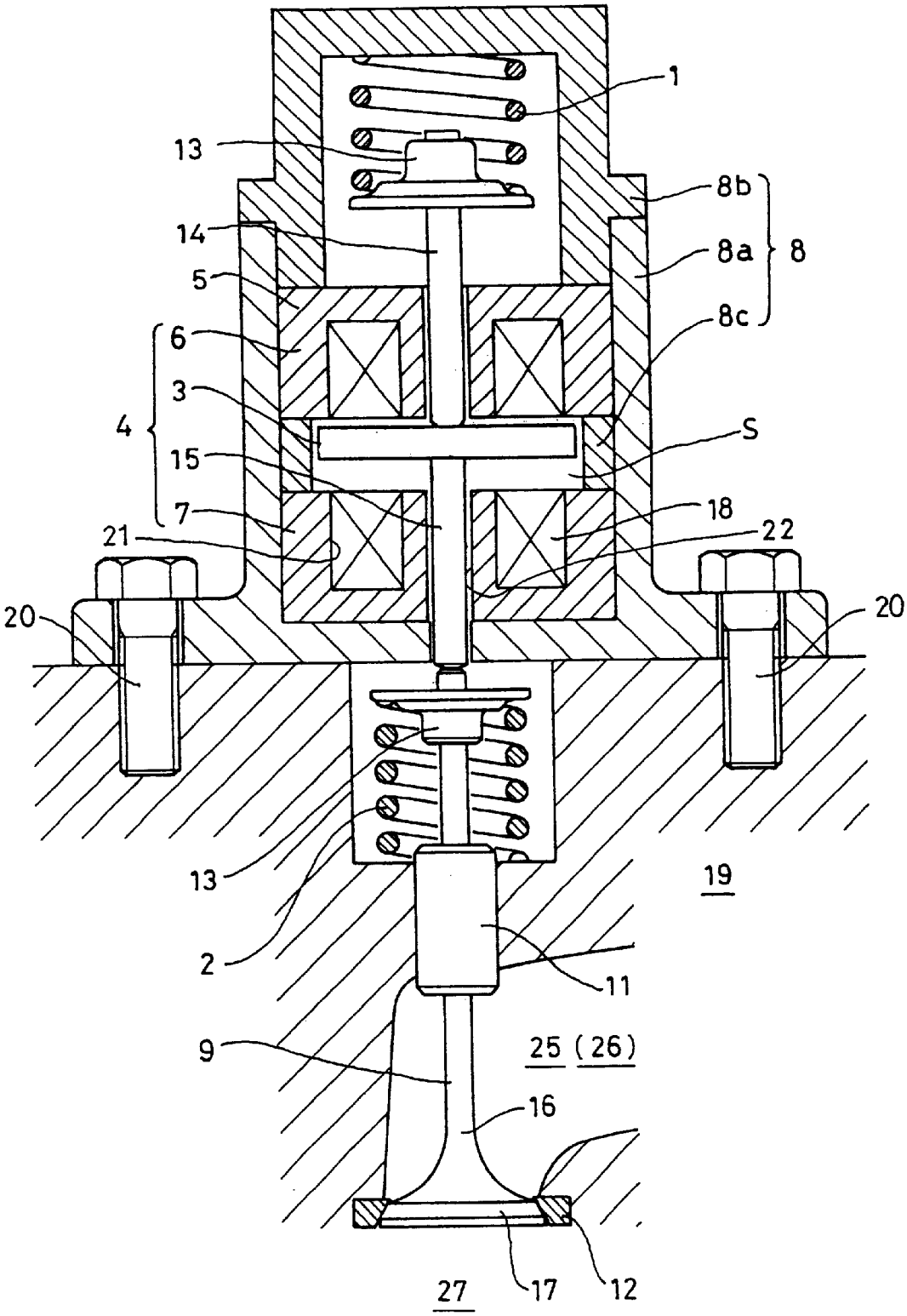
FIG. 1 is a sectional view of a valve-open-close mechanism embodying the present invention.

The electromagnetic actuator 4 for an internal combustion engine according to this invention has, as shown in FIG. 1, a pair of electromagnets 6, 7, an armature 3, and a first stem 15.

The armature 3 is mainly made from a magnetic material. The electromagnets 6, 7 are each made up of a stator 5 and a coil 18. By passing a current through the coils 18, a magnetic field is produced. The pair of electromagnets 6, 7 are provided opposite to each other with a gap 10 therebetween. The armature 3 is disposed in the gap 10. Thus, the armature 3 is reciprocable between the two electromagnets 6, 7 by the magnetic field produced by the electromagnets. If the armature is joined or mechanically fastened to the first stem 15 or the second stem 14, by the first stem 15 or the second stem 14 or if an inter-electromagnet housing 8*c* is provided very close to the outer peripheral surface of the armature 3, using the inter-electromagnet housing 8*c* as a guide, the armature 3 can be smoothly reciprocated between two electromagnets 6, 7.

In order to transmit the movement of the armature 3 from one electromagnet 6 toward the other electromagnet 7, the first stem 15 is provided at one side of the armature to which it moves. By the first stem 15, the movement of the armature 3 from the side of the electromagnet 6 toward the side of the electromagnet 7 acts on the valve 9, which is in abutment with the tip of first stem 15, thereby opening the valve of the internal combustion engine. The first stem 15 may be integral with the valve 9.

The stators 5 may be manufactured by machining an iron-family material, but may be manufactured by molding an iron-family powder by powder molding. Specifically, it can be manufactured by molding iron-family powder by cold mold press molding, warm mold press molding or an injection molding.

In contrast, with a conventional electromagnet, as shown in FIG. 7, since a coil is wound around a stator 34 formed with a recess 32 to house an electromagnetic copper plate 31 or a guide hole 33 is formed by machining, it is large in volume as an electromagnet, and machining such as cutting is necessary.

Figure 4A:
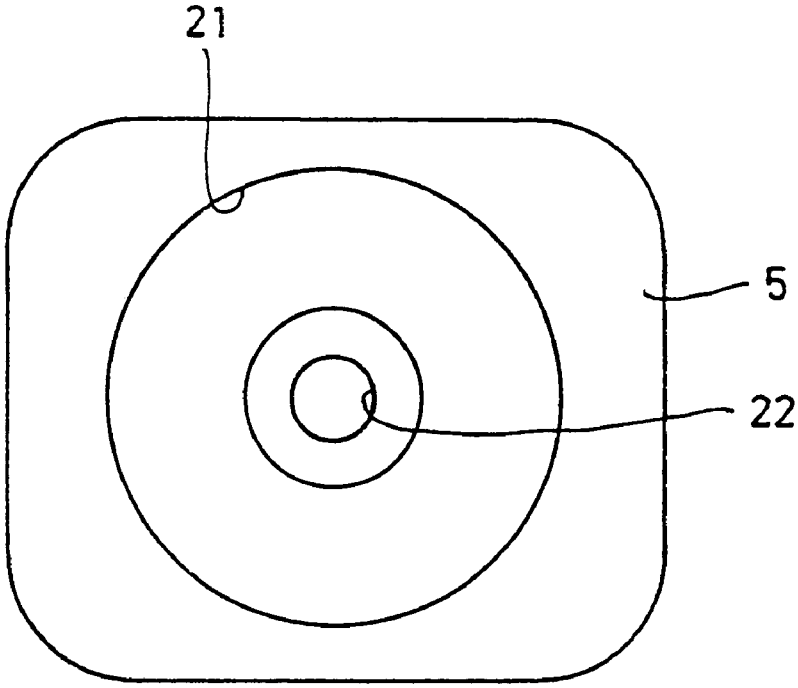
FIG. 4A is a plan view of a stator embodying this invention.
Figure 4B:
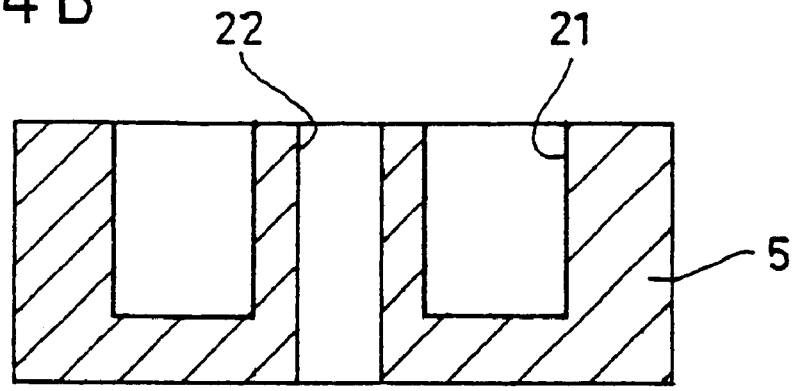
FIG. 4B is a front sectional view of the stator of FIG. 4A.

Thus, by employing by powder molding, as shown in FIG. 4, the recess 21 and the guide hole 22 can be formed with good accuracy, so that machining after molding can be omitted. The stator can be designed more compact than a conventional one. Also, since it is possible to mount a pre-made coil in the recess 21, the number of manufacturing steps is fewer and mass-productivity is high.

In order to increase the density of the molded member obtained, obtain the same flux density as conventional electromagnets, and mold more compact stators 5, warm pressing or injection molding is advantageous.

The iron-family powder used for powder molding may be an ordinary iron-family powder, but an iron-family powder having an iron oxide film or a resin coated film is preferable. If powder molding is carried out using such an iron-family powder, as a constituent component of stators obtained, part or whole of the iron oxide film or coated resin film remains. Thus, formation of eddy current, which tends to be produced in a solid metal, is suppressed, so that stators 5 with low iron loss are obtained. The stator can be disigned more compact than a conventional one. The iron oxide film is a film formed by oxidising the surface of an iron-family powder. The resin coated film is a film formed on the surface of an iron-family powder by applying, immersing or depositing a thermoplastic or thermosetting resin.

Thus, with the electromagnets 6, 7 using such stators, due to the effect of reduction in volume, reduction in volume of the constituent parts including the below-described housing 8 is achieved, so that it is possible to reduce their weights.

Heretofore, when the stems were passed through the guide holes 33 of the stators 34, it was necessary to mount slide bearings. In contrast, if the above stators 5 are used, since surface smoothness and dimensional accuracy of the molded members are assured, no slide bearings are necessary, so that it is possible to insert the first stem 15 and the second stem 14 into the guide holes 22, 22'. This leads to reduction of the number of parts, which in turn results in reduction in weight and improved mass-productivity.

The coils 18 may be formed from a copper-family material. But it is preferable to form them from aluminum or a material containing aluminum as its major component. With this arrangement, a reduction of weight of the coils 18 is achieved. As the coils 18, a 1000-family or 6000-family aluminum alloy specified in JIS H 4000 may be used. As a coating material of the coils 18, heat resistance of 180° C. or over is required. It may be an esterimide, a polyimide or a polyamide-imide.

Next, the valve-open-close mechanism for an internal combustion engine according to this invention comprises an electromagnetic actuator 4, a housing 8, a valve 9 and a second stem 14.

The electromagnetic actuator 4 is housed in a housing 8, which is fixed to an internal combustion engine body 19 by fixing members 20.

The housing 8 comprises, as shown in FIG. 1, a housing 8*a* covering the outer peripheral surfaces of the electromagnets 6 and 7, a housing 8*b* covering the top ends of the electromagnets 6, 7, and an inter-electromagnet housing 8*c* for keeping the gap 10 between the two electromagnets 6, 7. But as the housing 8, it is not limited to a structure formed of these three members but may be formed of any desired members according to the assembling conditions of the valve-open-close mechanism for an internal combustion engine according to this invention.

The material forming the housing 8 may be an iron-family material, but an impregnated composite material in which a metallic material has been impregnated into an aggregate comprising a metallic porous member is preferable. By using such a material, a housing high in strength is obtained. Also, reduction in the wall thickness of the housing and making it compact are possible. Thus, it is possible to lighten the weight.

The metallic porous member may be manufactured by subjecting a foamed resin to a conductive treatment with graphite or the like, electroplating it, and subjecting it to heat treatment to remove the foamed resin, or by impregnating a foamed resin with metal/resin slurry, drying and subjecting it to heat treatment to remove the foamed resin.

As the metallic porous member, a high-strength alloy material containing Fe, Cr, Ni, etc. is preferable. Its volume rate is, though it depends on the required strength and weight, preferably within the range of 3 to 20%.

As the metallic material to be impregnated into the aggregate comprising the metallic porous member, one or two or more selected from a material containing aluminum as its major component such as an aluminum metal, an aluminum alloy or the like, a material whose major component is a magnesium such as a magnesium metal or a magnesium alloy or the like, and foamed aluminum may be used.

As a method of impregnating an aggregate comprising a metallic porous member with a metallic material, a die-cast method, a high-pressure forging method such as molten metal forging, or an impregnation-forging method at a low pressure of several MPa or under can be used. This is because the cell hole diameter of the metallic porous member is of a relatively large size of 0.1 mm to 1 mm and it has an open-cell structure in which all cells communicate with one another.

The foamed aluminum is a foamed-state aluminum or aluminum alloy obtained by melting aluminum or an aluminum alloy such as an aluminum-calcium alloy, and adding a foaming agent such as titanium hydride or zirconium hydride to it to cause foaming by decomposition of the foaming agent.

With the thus obtained impregnated composite material, if an aluminum-family material or a magnesium-family material is used as the metallic material, it is possible to reduce the weight as a whole and thus the weight of the housing 8 itself.

As the fixing members 20, bolts are usually used as shown in FIG. 1. As the material for the fixing members 20, an iron-family material can be used. But it is preferable to use a material whose major component is an aluminum such as aluminum metal or an aluminum alloy.

By using a material whose major component is aluminum as the fixing members 20, reduction in the weight is achieved. Also this is preferable because the internal combustion engine body 19 for mounting the housing 8, such as an engine head, is made from an aluminum-family material, so that it is possible to suppress stress due to a difference in the thermal expansion coefficient when a change in temperature occurs during assembling or operation. As specific examples of the material forming the fixing members 20, materials specified under JIS H 4000 are preferable. In view of tensile strength, 4000-, 5000-, 6000- and 7000-family materials (under JIS H 4000) are preferable.

For the internal combustion engine 19, a valve 9 for communicating an intake port 25 and an exhaust port 26 with a combustion chamber 27 and shutting them off is provided.

The valve 9 is provided such that by moving the armature 3 from the electromagnet 6 toward the electromagnet 7, the tip of the first stem 15 of the electromagnetic actuator 4 abuts the tip of the stem portion 16 of the valve 9 so that the valve opens.

In order to impart a biasing force for valve-closing operation to the valve 9, a retainer 13 is provided on the stem portion 16 of the valve 9 and a first return spring 2 is mounted between the retainer 13 and the internal combustion engine body 19. Further, a valve guide 11 for guiding the valve-opening and closing motion is provided on the internal combustion engine body 19.

Specifically, the marginal portion 17 of the valve 9 is provided at the boundary between the intake port 25 or exhaust port 26 and the combustion chamber 27, and at the boundary, a valve seat 12 is mounted. The valve 9 is closed by the first return spring 2 and the intake port 25 and exhaust port 26 are shut off from the combustion chamber 27. When the first stem 15 pushes the stem portion 16 of the valve 9 by the movement of the armature 3, the marginal portion 17 is pushed into the combustion chamber 27, so that the intake port 25 or exhaust port 26 and the combustion chamber 27 communicate with each other. Thereafter, by the biasing force imparted by the first return spring 2, the marginal portion 17 is again pressed against the valve seat 12, so that this line is shut off. Here, the valve seat 12 is a member for seating the marginal portion 17. This prevents the marginal portion 17 from directly colliding against the internal combustion engine body 19.

Also, the first return spring 2 is housed in a recess formed in the internal combustion engine body 19, and the valve guide 11 is provided so as to guide the stem portion 16 of the valve 9, which extends through the portion between the recess and the intake port 25 or exhaust port 26.

As for the material forming the retainers 13, 13', it may be an iron-family material. But for the purpose of reducing the inertia weight for improving the quick open-close properties of the valve 9 and reducing the total weight of the internal combustion engine, it is preferable to use aluminum alloy sintered material formed by sintering aluminum alloy powder molded using the below-described powder molding (hereinafter referred to as "aluminum alloy hardened material").

Since the aluminum alloy hardened material has heat resistance in a sliding condition, it is preferable that it has an alloy structure in which in fine aluminum-based crystal particles, a similarly fine intermetallic compound deposits to strengthen the heat resistance and also it is a dense material. As such an example, Al-17 wt %, Si-1.5 wt %, Zr-1.5%, Ni-2%, Fe-5%, Mm can be cited. Here, "Mm" is misch metal, namely, a composite metal formed mainly of rare earth elements such as lanthanum, cerium. By blowing high-pressure gas against alloy molten metal having such a composition, quenched solidified powder is formed. This is compressed, heated at about 500° C., and hot-forged to impart shapes for densification and at the same time to make it into a part. The thus obtained aluminum alloy hardened material having a predetermined shape is formed of fine aluminum-based crystal particles of about 100–1000 nm and strengthened by fine deposition of hard composite intermetallic compound of aluminum and other element metals on the base. The degree of densification is preferably 95% or over.

As the material for the retainers 13, the abovementioned aluminum alloy hardened material is preferable. This is because high fatigue characteristics are required because they are subjected to repeated stresses from the compression springs 1, 2. Thus it is necessary to adopt an alloy design in which fine crystal particles on a submicron order are formed and a quick-cool-solidifying process. By using this, it is possible to lessen the weights of the retainers 13 themselves.

Also, for the retainers 13, because sliding occurs against the first return spring 2 and second return spring 1 during high-speed valve operation, the aluminum alloy hardened material is sometimes insufficient. In such a case, by using the aluminum alloy hardened material formed from the above aluminum alloy powder containing 10 wt % hard particles having an average diameter of about 1–5 $\mu$m, and a maximum diameter of about 15 $\mu$m, it is possible to suppress wear. As the hard particles, nitride ceramic, oxide ceramic, carbide ceramic are preferable. As examples, silicone nitride, alumina, and silicon carbide can be cited.

The second stem 14 is provided at a surface opposite the surface of the armature 3 provided with the first stem 15. On the second stem 14, a retainer 13 is provided. Between the retainer 13' and the housing 8, the second return spring 1 for imparting a biasing force in the direction in which the second stem 14 pushes the armature 3 is provided.

The second return spring 1 opposes the biasing force of the first return spring 2, which acts on the armature 3 to prevent the armature from being pressed toward the other electromagnet 6 by the biasing force of the first return spring 2.

Figure 5:
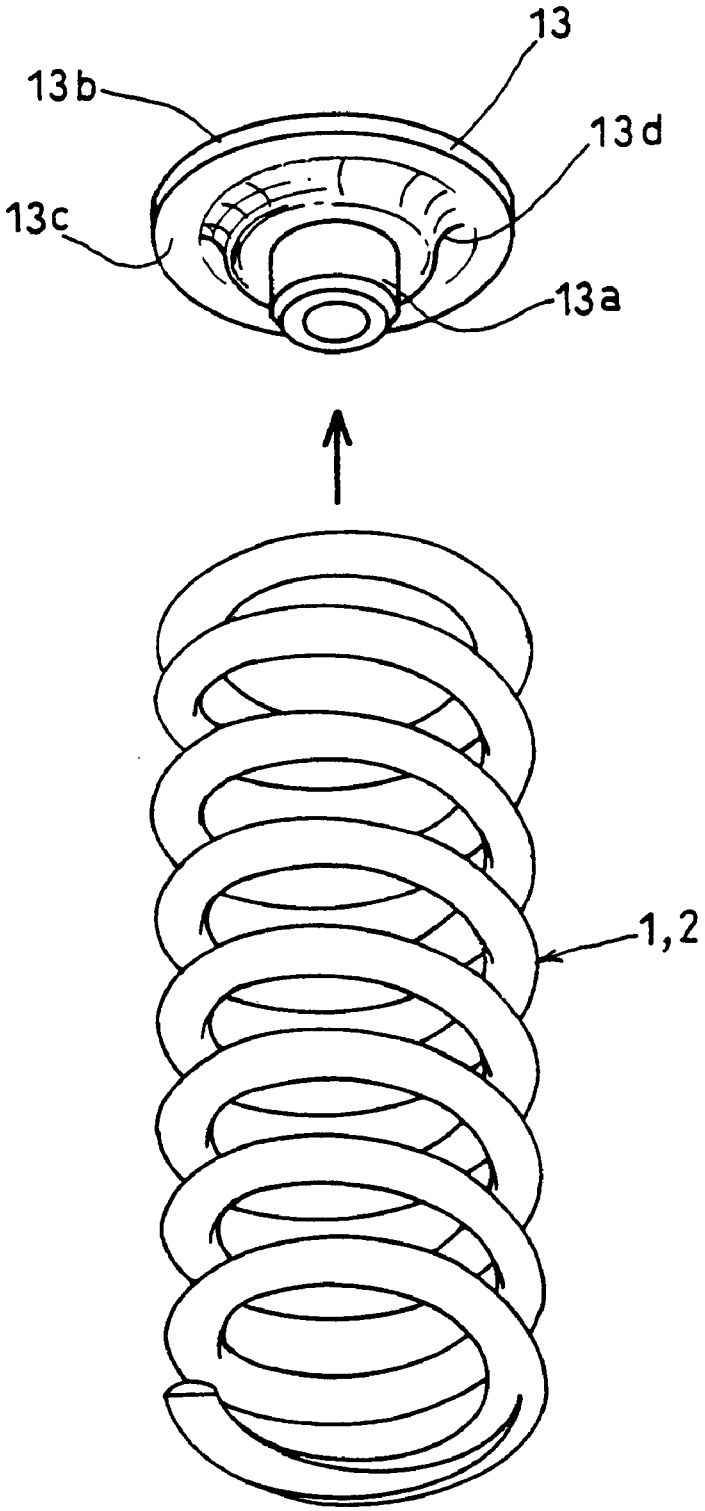
FIG. 5 is a perspective view showing one example of a retainer and a spring.
Figure 6:
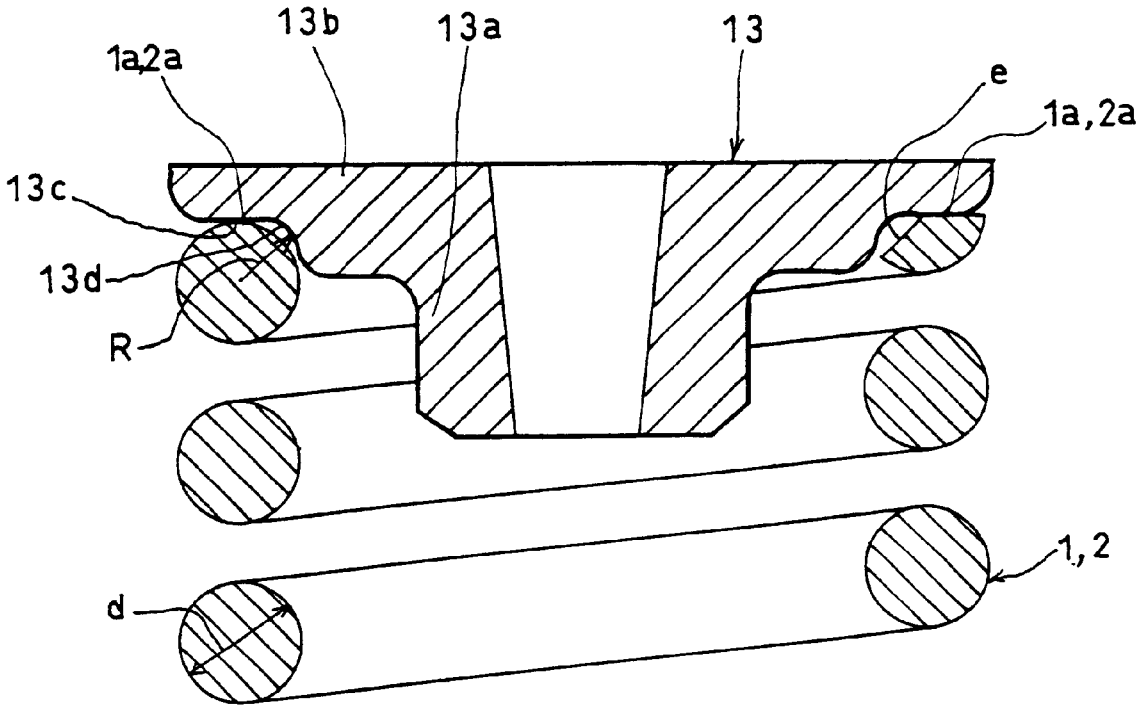
FIG. 6 is a view showing how the retainer and the spring operate.

As shown in FIGS. 5 and 6, the retainers 13 comprise a boss 13*a* and a spring support 13*b*. A corner portion 13*d* extending from a spring-abutting horizontal surface 13*c* of the spring support 13*b* to the boss 13*a* is made arcuate. The radius of curvature R of the arc is derived from the following formula:

$$K=P\times d\times(1-0.4R)\leqq C\times t=Q[N\cdot mm]$$

wherein

Q: Allowable stress for the retainer 13

P: Spring load produced when spring 1, 2 is compressed to the limit d: Wire diameter (mm) of spring 1, 2 t: Fatigue strength of material used for retainer 13

C: Constant

The inner-diameter corner e of the end of the spring 1, 2 has a cut shape so as not to ride on the corner portion 13*d* of the retainer 13. Also, on the abutting surfaces 13*c* of the retainer 13, it is preferable to provide a coating such as DLC (diamond-like carbon) to achieve a reduction in sliding resistance.

The material forming the first stem 15 or second stem 14 may be an iron-family material. But in order to achieve reduction in weight, a ceramic material whose major component is silicon nitride or SIARON, aluminum alloy hardened material, titanium alloy, etc may be used. As the silicon nitride, to ensure reliability against breakage, use of a sintered member containing 80 wt % or more of silicon nitride or SIALON and having a relative density of 95 wt % or over is preferable.

The usable ceramics include fiber-reinforced ceramics and whisker-reinforced ceramics.

As the aluminum alloy hardened material, it is required that it is a high-temperature slide member having a heat resistance in a sliding condition, the abovesaid aluminum alloy hardened material may be used.

The first stem 15 and second stem 14 may be made of the same material or different materials.

On the surface of the first stem 15 and the second stem 14, a ceramic coating film or a carbon-family coating film may be provided. This reduces the dynamic friction coefficient and possibility of seizure on the sliding surface when the first stem 15 or second stem 14 is driven in the guide hole 22 of the stator 5 and thus reduces the energy loss due to sliding.

As the material forming the coating film, a ceramic coating film of a nitride, carbide, carbonitride, oxy-nitride, oxy-carbide or carbo-oxy-nitride of a metal in the IVa, Va, VIa groups of the periodic table or aluminum (Al), boron (B) or silicon (Si), a DLC (diamond-like carbon) film, a diamond film or a carbon nitride film can be cited.

As the structure of the coating film, a coating film formed of one kind of material among the above materials, a mixed film formed of two kinds or more of them, and a laminated film formed of the above said coating film and the abovesaid mixed film. By providing such a coating film, it becomes unnecessary to forcibly supply lubricating oil to the sliding surface when the first stem 15 or the second stem 14 is driven in the guide hole 22 of the stator 5. This suppresses a failure of the actuator 4.

The armature 3 may be, if necessary, joined to or mechanically fastened to one or both of the first stem 15 and second stem 14. With this arrangement, it is possible to guide the reciprocating movement of the armature 3 between the electromagnets 6 and 7.

As the first stem 15 or second stem 14 to be joined to or mechanically fastened to the armature 3, if a stem using a material smaller in specific weight than the armature 3 is selected, it is possible to reduce the weight than when an integral driving member is formed using a material as the same kind as the armature 3.

As a method of coupling the armature 3 and first stem 15 by joining or mechanical coupling, slidably coupling them together, bonding them together, or mechanically coupling them together can be cited. To ensure reliability of detaching and attaching, a joint means using a retainer in which a recessed groove is formed in the circumferential direction of the stem and the armature 3 is sandwiched there. Here, as a lighter material than the armature 3, ceramic material whose major component is silicon nitride or SIALON, an aluminum sintered material by powder molding, and a titanium alloy can be cited.

The material forming the first return spring 2 or the second return spring 1 may be an iron-family material. But by using the following material, namely, an alloy steel containing C: 0.55–0.70 wt %, Si: 1.0–2.2 wt %, Cr: 1 wt % or under, Mn: 1 wt % or under, V: 0.2 wt % or under, and if necessary, Mo and Nb, having a tensile strength of 1960 $N/mm^2$, inclusion such as $SiO_2$ and $Al_2O_3$ being 25 $\mu$m or under, and having a tempered martensitic structure, it is possible to obtain desired spring characteristics and lessen the spring weight. In the case of such a high-strength steel, after melt casting and hot pressing, it is worked to an intended wire diameter by combining shaving, wire drawing and patenting, and then hardening and tempering to obtain a steel wire. Thereafter, coiling, strain-removing annealing, shot peening, and if necessary, nitriding, shot peening and strain-removing annealing are usually carried out.

Further, as the material of the first return spring 2 or second return spring 1, if a titanium alloy comprising a total of 13 wt % of Al and V, having a tensile strength of 1500 $N/mm^2$ and having a surface coating that is good in wear resistance is used, it is possible to obtain desired spring characteristics and lessen the spring weight. The high-strength titanium alloy is melted in a vacuum, melt-forged repeatedly until component segregation decreases sufficiently, hot-pressed, then solution treatment and wire drawing repeatedly. After it has been worked to an intended wire diameter, it is subjected to ageing treatment. The steps after coiling are basically the same as mentioned above.

Furthermore, as the material of the first return spring 2 or second return spring 1, if an aluminum alloy containing a total of 5 wt % or more of Cu, Mg and Zn, having long crystal particles having an aspect ratio of the crystal particle diameter of 3 or over, and a tensile strength of 600 $N/mm^2$ or over, it is possible to obtain desired spring characteristics and lessen the spring weight. The high-strength aluminum alloy is formed into a powder of an intended composition, the powder is solidified into an ingot, and subjected to either or both of forging and pressing, wire drawing and solution treatment repeatedly to an intended wire diameter, and finally, ageing treatment. The steps after coiling are basically the same as with high-strength steel but no nitriding is done.

Also, in order to use the abovementioned titanium alloy and aluminum alloy for the first return spring 2 or second return spring 1, a coating film may be provided to improve the wear resistance of the surface, if necessary.

The valve 9 is formed from a marginal portion 17 forming a valve and a stem portion 16 forming a shaft. The material forming the valve 9 may be an iron-family material but may be such a material that the marginal portion 17 has heat resistance. For example, an aluminum alloy hardened material may be used as the stem portion 16 and a heat-resistant steel alloy as the marginal portion 17. A ceramic material whose major component is silicon nitride or SIALON may be used for both the stem portion 16 and marginal portion 17. By using these materials, it is possible to maintain heat resistance of the marginal portion 17 forming the valve and contribute to the reduction in weight.

As the heat-resistant steel alloy, JIS SUH3 (Fe-11 wt % Cr-2 wt % Si-1 wt % Mo-0.6 wt % Mn-0.4 wt % C) or the like can be cited as an example.

As the silicon nitride, to ensure reliability against breakage, use of a sintered member containing 80 wt % or more of silicon nitride or SIALON and having a relative density of 95 wt % or over is preferable.

The ceramics include fiber-reinforced ceramics and whisker-reinforced ceramics.

If such an aluminum alloy hardened material is used as the stem portion 16 and a heat-resistant steel alloy is used as the marginal portion 17, they can be joined together by hot pressing.

By making the stem portion 16 and the marginal portion 17 from different materials and joining them together, it is possible to form most part of the valve 9 from an aluminum alloy and thus reduce the weight, and to selectively strengthen the portion that will be exposed to burning and heated to high temperature.

Also, for the aluminum alloy hardened material and titanium alloy material, in order to improve wear resistance of the sliding surface on the surface of the stem portion 16, the below-described ceramic coating film or carbon-family coating film, or an oxide film may be provided.

Figure 2:
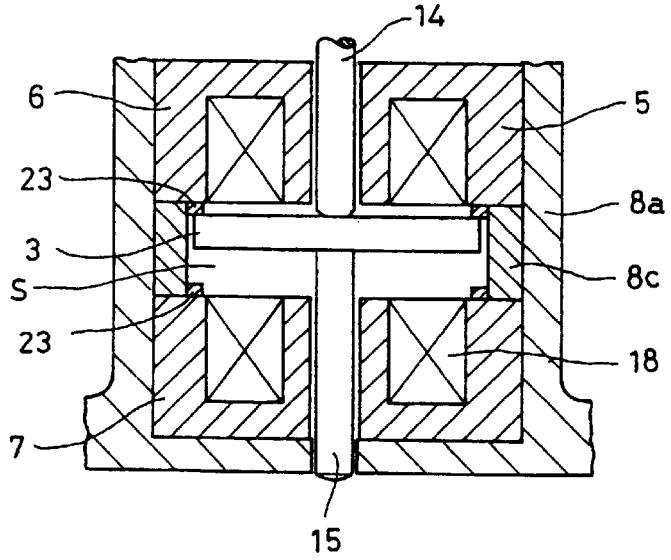
FIG. 2 is an enlarged sectional view of a portion of another embodiment.
Figure 3:
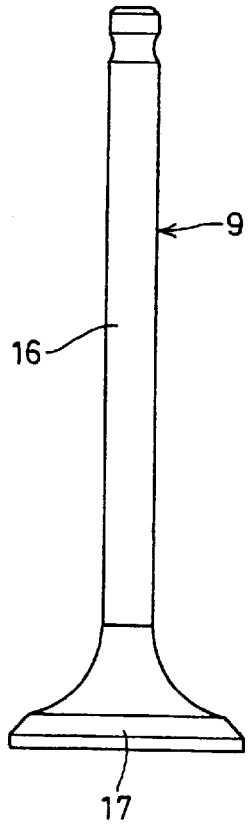
FIG. 3 is a front view showing a valve.

In this invention, if the stator 5 is formed by molding an iron-family powder by powder molding, during operation of the valve-open-close mechanism, if the armature 3 and the stator 5 contact directly each other, it is liable to wear or chipping. Thus, it is preferable to reciprocate the armature 3 so as not to directly contact the stator 5. For this purpose, the reciprocating motion of the armature 3 may be controlled by an electric circuit, or stoppers 23 may be provided between the stator 5 and the armature 3 as shown in FIG. 2.

Also, the valve-open-close mechanism can be used either for an exhaust line or an intake line. If a heat-resistant steel alloy is used for the marginal portion 17 of the valve 9, it is preferable to use it in an intake line. If silicon nitride or a SIALON-family ceramic material is used for the marginal portion 17 of the valve 9, it is preferable to use it for an exhaust line.

It is not necessary to manufacture all of the first stem 15, second stem 14, housing 8, valve 9, first return spring 2, second return spring 1, retainers 13 and fixing members 20 of the above-described metal or its alloy, which is smaller in specific weight than iron, an alloy or a ceramic or a fiber- or whisker-reinforced ceramic reinforced with an aggregate which is smaller in specific weight than iron. Even if at least one of them is formed of such a material, and the others are formed of an iron-family material, it is possible to achieve lessening the weight of an electromagnetic actuator for an internal combustion engine or a valve-open-close mechanism for an internal combustion engine obtained.

[EXAMPLES 1, 2]

The parts forming the valve-open-close mechanism shown in FIG. 1 were manufactured from the following materials to form the valve-open-close mechanism.

(Armature)

As the armature 3, an existing magnetic steel material was used. The below-described first stem 15 was fitted, pressed and joined.

(Stator)

The stator 5 of a shape shown in FIG. 4 was manufactured from a powder compressed molded body. Iron powder used was pure iron powder. It was manufactured by steps of preparing a powder solidified by quenching by blowing high-pressure water against molten metal, drying, and adjusting powder particle diameter distribution by passing through a mesh of a predetermined size. These steps are the same as in manufacturing an ordinary starting raw material powder for sintered machine parts. Thereafter, in order to assure insulation between pure iron powders, an oxide film forming step was carried out by heat treatment.

Main impurities before the formation of an oxide film were about 0.1 wt % of oxygen, about 0.05 wt % of Si and Mn, and about 0.005 wt % of carbon, phosphorus and sulfur. The powder particle diameter is controlled in the quench-solidifying step and the particle diameter distribution adjustment step for smooth and uniform flow filling into a mold, and so that as high an apparent density as possible is obtained. The particle diameter distribution thus obtained was such that 5–10 wt % were less than 200 μm and 150 μm or over, 40–50 wt % were less than 150 μm and 75 μm or over, and 40–50 wt % were less than 75 μm and 30 μm or over. According to the flow property evaluation under JSPM standard, which is an index of flow filling properties, for the powder having such a particle diameter distribution, the time taken for 50 grams of powder housed in a funnel container having an outlet diameter of 2.5 mm to pass the outlet was 20–30 seconds. Also, the apparent density under the standard was 2.9–3.5 g/cm$^3$.

In order to manufacture the stator 5 by molding this powder, the powder was charged into a mold, and in order to prevent seizure between the mold and the iron powder in uniaxially compressing, 0.5–0.7 wt % of organic resin containing a thermosetting resin as its major component was blended.

The powder compressed molded body obtained by cold-compression-molding the powder was 7.1 g/cm$^3$ in density. For a powder compressed molded material obtained by warm compression molding, the density was 7.4 g/cm$^3$. In warm compression molding, the mold and the powder to be compressed were controlled to a temperature of 130° C. to 150° C. . The reason why the density was high in this case was mainly because the yield stress of the iron powder decreased and the deformability increased due to softening, so that the consolidation property increased.

These molded members were calcined at 200° C. in the atmosphere to obtain stators 5.

Generally, in an alternating magnetic field, the higher the frequency, the more an eddy current is produced and the more loss of magnetic force occurs. But with an aggregate of such a powder, production of eddy current is suppressed in the powder units, so that it is possible to lower the loss. With this stator 5, due to its structural feature, there is little anisotropy in permeability. Dimensional variations after molding and calcining were small, so that no additional working was necessary. Thus, there was no need to set a bearing for passing the stem 14, 15.

Figure 7A:
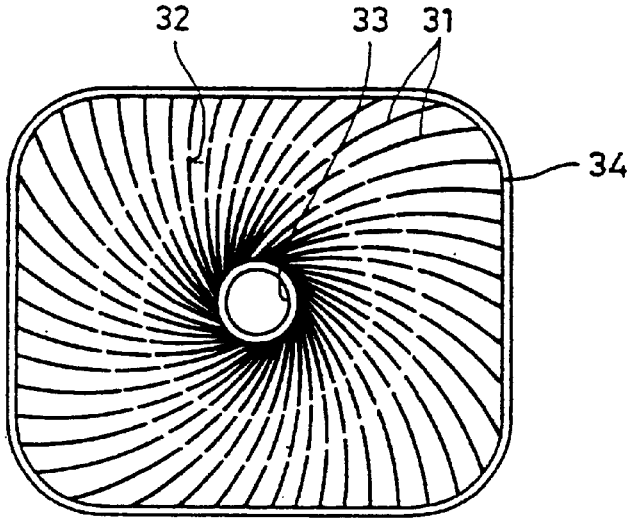
FIG. 7A PRIOR ART
FIG. 7A is a plan view showing an example of a conventional stator.
Figure 7B:
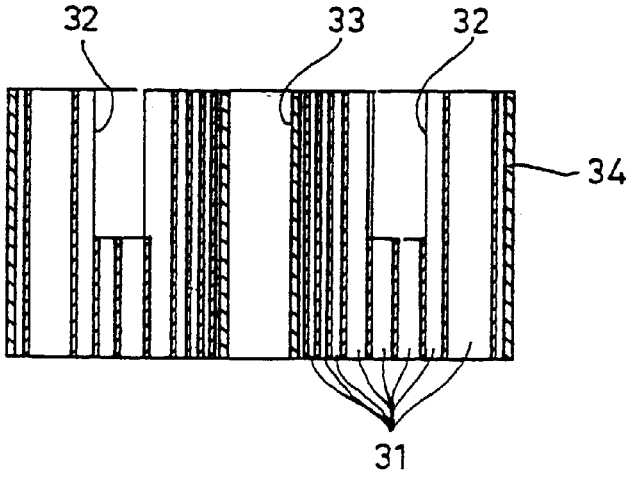
FIG. 7B PRIOR ART
FIG. 7B is a front sectional view of the same.

Comparative members were manufactured of a laminated silicon steel plate. For the laminated silicon steel plate, in view of the balance of punching workability and higher permeability than iron, a unidirectional silicon steel plate containing 3 wt % silicon was used. Since anisotropism is produced that the permeability is large in the rolling direction and small in a normal direction, as shown in FIGS. 7A and 7B, a laminated structure was used. For the purpose of suppressing eddy current, on the surface of the steel plate, an electric insulating resin layer was formed and it was assembled by superposing steel plates. Plates punched into strips were laminated and assembled, and fixed together by welding their ends with a laser. As for the accuracy of this stator, since the accuracy of the steel plate itself and the accuracy at the time of laminating and assembling are multiplied, it is impossible to expect a high dimensional accuracy compared with a stator formed by powder compression. Thus, machining was necessary at the end face on the side where the housing and the armature 3 contact with each other. Also, the dimensional accuracy of the hole for receiving the stem 14, 15 was also low, so that additional working and setting a bearing were necessary. The assembled laminated steel plate member had a density of 7.8 g/cm$^3$.

The maximum flux density for direct current of the stators thus formed by powder compression molding was 1.3 T for cold-molded members and 1.5 T for warm-molded members. In contrast, the maximum flux density for direct current when laminated silicon steel was used was 1.3 T.

From the above results, compared with laminated silicon copper plates, for powder compression molded members, it was confirmed that they showed equivalent or more than equivalent magnetic properties, though they were low in density and small in the number of manufacturing steps.

(Coil)

As the coil 18, a 6000-family material having a conductivy of 50% IACS specified in JIS H 4000 was used instead of a conventional copper-family material. As a coating material for the coil member, a polyimide resin was used.

(Stems)

As the first stem 15 and second stem 14, specimens made in the following manner were used. A powder in which 5 wt % of yttrium oxide and 2 wt % of aluminum oxide were wet-blended in ethanol into a commercial silicon nitride powder (α-crystal phase ratio: 90% or over, average particle diameter: 0.8 μm) was dried. After a predetermined molding organic binder had been added, the mixture was molded. Sintering was carried out at 1800 degrees in a 4-atm nitrogen gas atmosphere for 10 hours, and it was worked into a predetermined shape with a diamond grindstone. For this sintered member and a sintered member manufactured simultaneously, the three-point bending strength was measured under JIS R 1601. The average strength was 1050 MPa.

(Housing)

The housing 8 was manufactured by the following method. A slurry was prepared by mixing 65 parts by weight of Ni powder containing 18% Fe having an average diameter of 2.5 μm and 8% Cr, 2 parts by weight of a dispersant, 11 parts by weight of water and 12 parts by weight of phenolic resin. The slurry was impregnated into a polyurethane foam which had a thickness of 8 mm and in which the cell number per inch was 29, and excess slurry that adhered was removed by use of a metallic roll, and the sheet was dried for 10 minutes at 120° C. By heat-treating this sheet at 1200° C. under vacuum for one hour, a porous metallic member having a density of 0.91 g/cm$^3$ was prepared. After the metallic porous member has been worked into a cylindrical shape, it was set in a mold. By injecting under pressure of 1.2 MPa molten metal aluminum alloy (Al containing 2 wt % Cu) heated to 760° C. a housing comprising a metallic porous member/aluminum alloy composite material was manufactured. As a comparative member, a housing was also formed from only an aluminum alloy without compositing the metallic porous member. The tensile strength measured for each of them was as follows: composite material: 231 MPa, aluminum alloy: 142 MPa.

(Return coil spring)

The return coil spring was manufactured by the following method. By repeatedly subjecting a steel comprising C=0.65 wt %, Si=1.98 wt %, Mn=0.78 wt %, Cr=0.75 wt %, V=0.11 wt %, the remainder being substantially Fe to melt-forging, rolling, shaving, wire drawing, and heat treatment to obtain a wire 3.0 mm thick. Non-metallic inclusion were 20 μm at maximum. From this wire, a high-strength coil spring was manufactured by combining coiling, strain-removing annealing, shot peening and nitriding.

(Retainers)

For the retainers 13, because they retain the valve through a retaining part called cotter (retainer lock), and make a high-speed reciprocating motion integral with the valve 9, heat fatigue strength and shock strength are required. Also, with the rotation of the valve 9, they slide against the first return spring 2 and the second return spring 1, so that wear resistance is also required. To assure heat fatigue strength and shock strength, for an aluminum alloy hardened material, an alloy design for forming submicron fine crystal particles and a rapid-cool-solidifying process are required. As such an aluminum alloy hardened material, using Al-17 wt %, Si-1.52 wt %, Zr-1.5 wt %, Ni-2 wt %, Fe-5 wt %, Mn, an aluminum powder having an average particle diameter of 50 $\mu$m was manufactured by gas cooling solidifying process and it was used as a starting material. Also, in view of the requirement of wear resistance, because it is difficult to deal only with an aluminum alloy powder, as hard particles, 9 wt % of alumina particles having an average particle diameter of 2 $\mu$m and a maximum particle diameter of 12 $\mu$m were added.

After uniaxial powder compression molding, it was heated at 500° C. and densification and imparting final-shape were carried out simultaneously by hot forging. Thereafter, in order to remove burrs and layers at the surface-layer portion where powder bonding was weak, barrel treatment was carried out. No machining was carried out. The density was 3.2 g/cm$^3$.

Since the retainers 13 are subjected to repeated spring loads from the coil springs 1, 2, mechanical strength is required to withstand the spring loads. Thus, as shown in FIGS. 5 and 6, the retainers 13 comprise a boss 13*a* and a spring support 13*b*, and a corner portion 13*d* extending from the spring-abutting horizontal surface 13*c* of the spring support 13*b* to the boss 13*a* is made arcuate so that the radius of curvature R of the arc is a value derived from the above formula 1.

For conventional retainers, steels for machine structures such as JIS 17C or if circumstances require, alloy steels such as JIS 17C SCr415 are often used. The retainer as a comparative member was manufactured using the latter. After shape imparting to the latter alloy steel by hot forging, it was roughly machined, carburized and annealed and then finish working was done. The density was 7.8 g/cm$^3$. Heretofore, no consideration has been given to the corner portion 13*d* and the comparative member was as such.

(Bolts)

As the bolts used for mounting the housing 8 to the internal combustion engine body 19, a 4000-family material stipulated under JIS H 4000 was used against a conventional steel material.

(Valve)

As the valve 9, 5 wt % of yttrium oxide and 2 wt % of aluminum oxide were wet-blended into a commercial silicon nitride powder ($\alpha$-crystal phase ratio: 90% or over, average particle diameter: 0.8 $\mu$m) in ethanol. The powder obtained was dried. After a predetermined organic molding binder had been added, predetermined molding was carried out. Thereafter sintering was carried out at 1800 degrees in a 4-atm-pressure nitrogen gas atmosphere for 10 hours, and it was worked into a specimen of predetermined shape by a diamond grindstone. For this sintered member and a sintered member manufactured simultaneously, when the three-point bending strengths were measured under JIS R 1601, the average strength was 1050 MPa.

(Valve-open-close mechanism)

Using the abovesaid parts, electromagnetic actuators and valve-open-close mechanisms were manufactured.

[EXAMPLES 2]

Except that as the retainers and springs, the retainers 13 and coil springs 1, 2 were used, electromagnetic actuators and valve-open-close mechanisms were manufactured in the same manner as in Example 1.

(Retainer and Coil Spring)

On the surfaces 13*c*, 1*a*, 2*a* of the retainers 13 and coil springs 1, 2 manufactured in Example 1, a DLC film was formed in the following method which is a known capacitive coupling type plasma CVD method. A stem base member washed with a solvent or a detergent and dried was mounted to an electrode connected to a high-frequency power source (frequency: 13.56 MHz). After exhausting at a degree of vacuum of $1\times10^{-4}$ Pa, argon gas was introduced until it was maintained at a pressure of $1\times10^{-1}$ Pa. In this state, a high frequency output of 400 W was supplied to the electrode from the high-frequency power source, and maintained for 15 minutes so that the electrode carrying the stem would be covered by plasma. After a natural oxide film on the surface of the base member had been removed by ion cleaning, the supply of argon gas was stopped and methane gas was introduced until it was maintained at a pressure of $1\times10^{-1}$ Pa, and a high frequency output of 600 W was supplied to the electrode from the high-frequency power source to form a DLC film. The film thickness was about 1 $\mu$m.

[COMPARATIVE EXAMPLE 1]

Using the abovesaid comparative members for the stator 5, housing 8 and retainer 13 and coil springs 1, 2, and parts formed of an iron-family material for the other parts, an electromagnetic actuator and a valve-open-close mechanism were manufactured.

[Results]

The weights for Examples 1–2 and Comparative Example 1 were measured. For Examples 1 and 2, compared with Comparative Example 1, as the total weight, 70 wt % of weight reduction was achieved.

Also, performance tests were conducted for the valve-open-close mechanisms of Example 1 and those of Example 2 using a 12 V direct current constant-voltage power source. Power consumption at that time was measured. As a result, in Example 2, the consumed power reduced by 5% compared with Example 1. Thus, it was found out that by the formation of the DLC film on the surface 13*c* of the retainer 13 and the surfaces 1*a*, 2*a* of the coil springs 1, 2, it was possible to further reduce the sliding resistance between the retainer 13 and the coil springs 1, 2.

[Mechanical strength test of retainers]

In order to confirm the mechanical strength of the corner portion 13*d* of the retainer 13 extending from the spring support 13*b* to the boss 13*a*, for the springs 1, 2 and retainers 13 prepared in the above Examples, tests were conducted with spring wire diameters d and radius of curvature R of the corner portion 13*d* as shown in Table 1. In the test, for each test example, the maximum compressive spring load P was repeatedly applied $10^8$ times. ○ indicates no damage on the corner portion and × indicates damaged and the test became impossible halfway due to damage were indicated by ×.

According to the test results, since usable (○) and unsable (×) are divided with a point near the K value of 2200 as a boundary (see test examples 4 and 14), the permissible stress level Q is 2200. From this result, C=12.22 [m$^4$](t: 180 MPa) is derived, so that it is apparent that the permissible R for the corner portion 13*d* is 0.5 or over, preferably 1.0 mm or over. The value of C is considered to be a constant for determining the permissible stress level Q for other materials too.

According to the present invention, since the mechanical strength of the retainer has been increased, even if the weight of the retainer is reduced, it can withstand practical use sufficiently.

TABLE 1

| Test Example | Spring wire diameter d (mm) | Max spring load P (N) | R potion Radius R (mm) | K value | Test result |
|---|---|---|---|---|---|
| 1 | 4.0 | 800.0 | 0.1 | 3072 | X |
| 2 | 4.0 | 800.0 | 0.2 | 2944 | X |
| 3 | 4.0 | 800.0 | 0.5 | 2560 | X |
| 4 | 4.0 | 800.0 | 0.8 | 2176 | ○ |
| 5 | 4.0 | 800.0 | 1.0 | 1920 | ○ |
| 6 | 4.0 | 800.0 | 1.5 | 1280 | ○ |
| 7 | 3.2 | 800.0 | 0.1 | 2457.6 | X |
| 8 | 3.2 | 800.0 | 0.2 | 2355.2 | X |
| 9 | 3.2 | 800.0 | 0.5 | 2048 | ○ |
| 10 | 3.2 | 800.0 | 0.8 | 1740.8 | ○ |
| 11 | 3.2 | 800.0 | 1.0 | 1536 | ○ |
| 12 | 3.2 | 800.0 | 1.5 | 1024 | ○ |
| 13 | 4.0 | 600.0 | 0.1 | 2304 | X |
| 14 | 4.0 | 600.0 | 0.2 | 2208 | X |
| 15 | 4.0 | 600.0 | 0.5 | 1920 | ○ |
| 16 | 4.0 | 600.0 | 0.8 | 1632 | ○ |
| 17 | 4.0 | 600.0 | 1.0 | 1440 | ○ |
| 18 | 4.0 | 600.0 | 1.5 | 960 | ○ |
| 19 | 3.2 | 600.0 | 0.1 | 1843.2 | ○ |
| 20 | 3.2 | 600.0 | 0.2 | 1766.4 | ○ |
| 21 | 3.2 | 600.0 | 0.5 | 1536 | ○ |
| 22 | 3.2 | 600.0 | 0.8 | 1305.6 | ○ |
| 23 | 3.2 | 600.0 | 1.0 | 1152 | ○ |
| 24 | 3.2 | 600.0 | 1.5 | 768 | ○ |

What is claimed is:

1. A valve-open-close mechanism for an internal combustion engine, said mechanism comprising an electromagnetic actuator, a valve actuated by said electromagnetic actuator for opening and closing an intake or exhaust port, and coil springs for giving a biasing force for opening and closing said valve, characterized in that a retainer is mounted to each of said coil springs and has a boss, an abutting surface abutting to said coil spring, and a corner portion extending from said abutting surface to said boss, said corner portion being formed arcuately.

2. The valve-open-close mechanism for an internal combustion engine as claimed in claim 1 wherein said electromagnetic actuator comprises a pair of electromagnets each made up of a stator and a coil opposed to each other with a gap therebetween; an armature disposed in said gap so as to be reciprocable between said pair of electromagnets by driving said electromagnets; and a first stem for transmitting to external the movement of said armature from one electromagnet toward the other electromagnet;

said electromagnetic actuator being housed in a housing mounted to an internal combustion engine body;

said armature being moved from said one electromagnet toward said other electromagnet, so that said first stem opens said valve by pushing said valve;

said electromagnetic actuator further comprising a first retainer provided on said valve for imparting a biasing force to said valve for a valve-closing operation, and a first return spring mounted between said first retainer and the internal combustion engine body;

a second stem provided at a surface of said armature on the side not coupled to said first stem; and a second retainer provided on said second stem, and a second return spring mounted between said second retainer and said housing for imparting a biasing force.

3. The valve-open-close mechanism for an internal combustion engine as claimed in claim 1 wherein the radius of curvature R of the arc of said corner portion is derived from the following formula:

$$K=P\times d\times(1-0.4R)\leqq C\times t=Q[N\cdot\mathrm{mm}]$$

wherein

Q: Allowable stress for the retainer 13

P: Spring load produced when spring 1, 2 is compressed to the limit d: Wire diameter (mm) of spring 1, 2 t: Fatigue strength of material used for retainer

C: Constant.

4. The valve-open-close mechanism for an internal combustion engine as claimed in claim 1 wherein said retainer is a powder molded article.

5. The valve-open-close mechanism for an internal combustion engine as claimed in claim 4 wherein said retainer is made from an aluminum alloy sintered body formed by powder molding.

6. The valve-open-close mechanism for an internal combustion engine as claimed in claim 1 wherein said first return coil spring or second return coil spring is made of an alloy steel containing 0.55–0.70 wt % of C, 1.0–2.2 wt % of Si, 1 wt % or under of Cr, 1 wt % or under of Mn, 0.2 wt % or under of V, having a tensile strength of 1960 N/mm$^2$ or over, containing inclusions of a size of 25 $\mu$m or under, and having a tempered martensitic structure.

7. The valve-open-close mechanism for an internal combustion engine as claimed in claim 1 wherein said first return spring or second return spring is made of a titanium alloy comprising a total of 13 wt % or over of Al and V, having a tensile strength of 1500 N/mm$^2$ or over and having a surface coating having a good wear resistance.

8. The valve-open-close mechanism for an internal combustion engine as claimed in claim 1 wherein said first return spring or second return spring is made of an aluminum alloy containing a total of 5 wt % or more of Cu, Mg and Zn, having long crystal particles having an aspect ratio of the crystal particle of 3 or over, and a tensile strength of 600 N/mm$^2$ or over.

9. The valve-open-close mechanism for an internal combustion engine as claimed in claim 1 wherein said valve comprises a marginal portion and a stem portion, said marginal portion being formed of a heat-resistant steel alloy, said stem portion being formed of an aluminum alloy sintered member formed by powder molding.

10. The valve-open-close mechanism for an internal combustion engine as claimed in claim 1 wherein said valve is formed of a ceramic material whose major component is silicon nitride or SIALON.

* * * * *